US005187820A

United States Patent [19]

Froutzis

[11] Patent Number: 5,187,820

[45] Date of Patent: Feb. 23, 1993

[54] CONVERTIBLE SEAT-BED

[76] Inventor: Andrew Froutzis, P.O. Box 4110, Elkhart, Ind. 46514

[21] Appl. No.: 848,857

[22] Filed: Mar. 10, 1992

[51] Int. Cl.[5] ..... A47C 17/17

[52] U.S. Cl. ..... 5/37.1; 5/41; 5/47; 5/55.1

[58] Field of Search ..... 5/18.1, 37.1, 41, 47, 5/48, 55.1, 57.1

[56] References Cited

U.S. PATENT DOCUMENTS

| | | | |
|---|---|---|---|
| 624,008 | 5/1899 | Genge | 5/55.1 |
| 3,171,684 | 3/1965 | Carte | 5/48 X |
| 3,856,347 | 12/1974 | Bell et al. | 5/47 X |
| 4,131,960 | 1/1979 | Quakenbush | 5/37.1 |
| 4,321,716 | 3/1982 | Schrock | 5/37.1 X |
| 4,756,034 | 7/1988 | Stewart | 5/37.1 |

*Primary Examiner*—Michael F. Trettel
*Attorney, Agent, or Firm*—Thomas J. Dodd

[57] ABSTRACT

A convertible seat-bed for a van or similar vehicle. The seat-bed includes a pivoting linkage which connects the seat support, back support, and the support frame. The linkage includes an over-center front link, and a dual scissors type linkage connected between the frame and back support. The seat frame includes a manually operated latch to secure the seat-bed in the seat position.

10 Claims, 6 Drawing Sheets

CONVERTIBLE SEAT-BED

FIELD OF THE INVENTION

This invention relates to seat-beds and will have application to seat-beds specially adapted for use in vehicles.

BACKGROUND OF THE INVENTION

Space and weight considerations in vehicles most often require the use of convertible seat-beds. Conventional seat-beds such as those shown in U.S. Pat. No. 4,321,176, and related patents utilize a well-known linkage system to pivotally connect the seat support and back support to the chair-bed frame.

Prior art linkage systems, including power driven systems, were very clumsy and unsturdy. Since the linkage in most cases is located towards the peripheral edges of the frame, it bears the weight of the seat and back supports in a manner which requires strong, durable links to avoid breakage or collapse. Further, DOT requirements for these linkage systems are often set at artificially high levels in order to ensure their safety.

Prior art linkage systems often fail to meet these rather stringent standards. Furthermore, these prior art systems are often difficult to operate manually, particularly as they age and the parts become worn due to constant use.

SUMMARY OF THE INVENTION

The convertible seat-bed of this invention includes a linkage system which is designed to meet all DOT requirements and is also easy to shift manually between the two extreme positions. The linkage includes a scissor type linkage which connects the back support to the seat-bed frame. Sliding, pivoting links connect the scissors linkage to the seat support and frame for easy manual shifting of the seat-bed between the seat and bed positions.

One of the links in the scissors linkage may include two link members which sandwich the other link and provide for added linkage stability. An over center pivoting link at the front of the frame and seat support may add to the stability and functionality of the linkage system for the present seat-bed.

The seat-bed of this invention may also include a manual latch which serves to lock the seat-bed in its seat position. The latch ensures that the seat-bed will not shift automatically into the bed position upon application of exterior force, such as occurs in an accident, which may cause injury to person on or near the seat-bed at the time of force application.

Accordingly, it is an object of this invention to provide for a new and useful convertible seat-bed.

Another object is to provide for a convertible seat-bed which meets or exceeds all DOT specifications.

Another object is to provide for a convertible seat-bed which is easily shifted between seat and bed positions through a unique linkage arrangement.

Another object is to provide for a convertible seat-bed which is of durable and enconomical construction.

Another object is to provide for a convertible seat-bed which may be positively locked in the seat position.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to explain the principles of the inventions and its application and practical use so others skilled in the art may understand its teachings.

Figure 4:
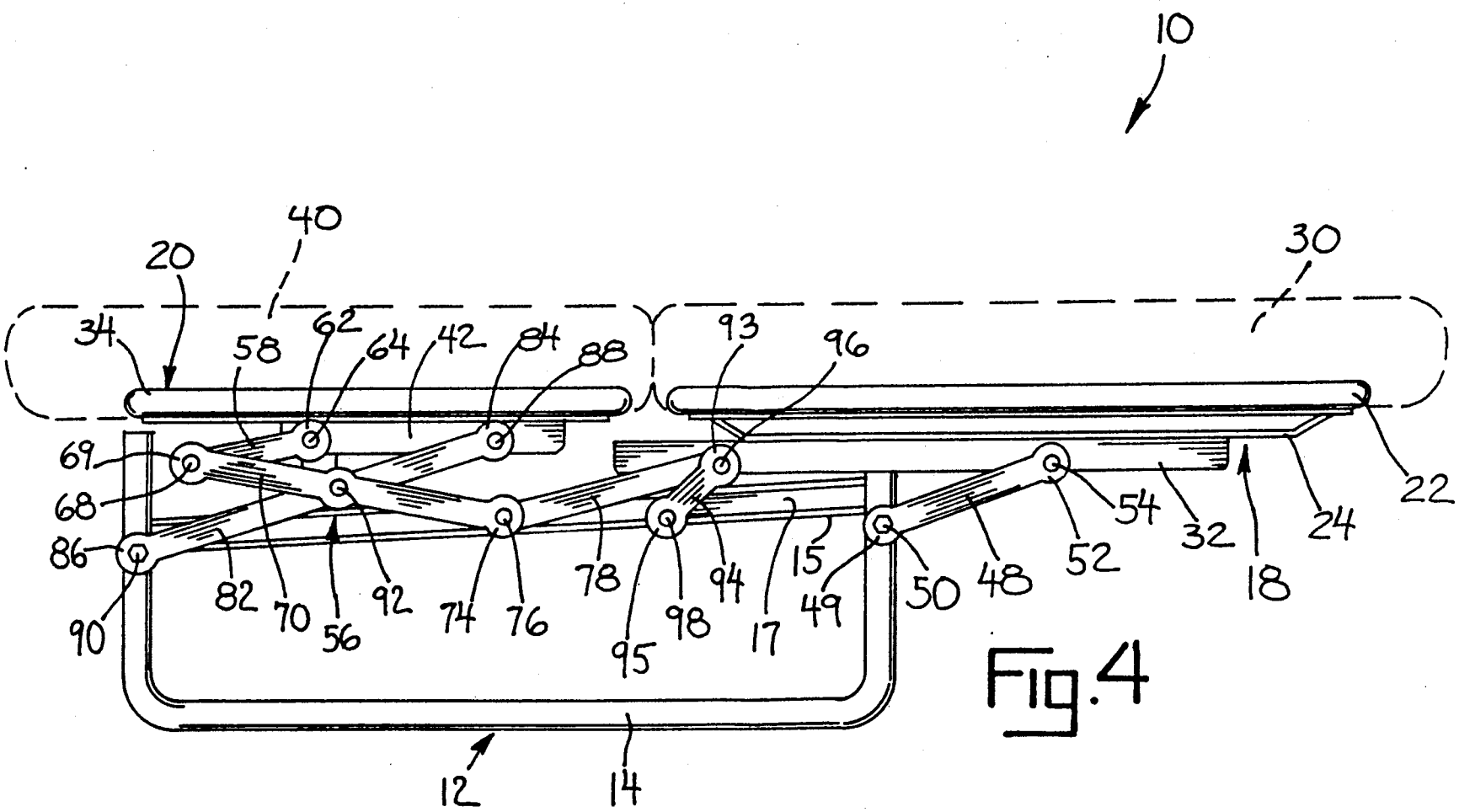
FIG. 4 is a side elevational view of the seat-bed in the bed position.

Referring to the drawings, reference numeral 10 generally designates the convertible seat-bed of this invention. Seat-bed 10 is preferably of the type used in van conversions, travel trailers, motor homes and other types of recreational vehicles. Seat-bed 10 is shiftable between a seat position (FIGS. 1 and 2) and a bed position. (FIG. 4).

As shown in FIGS. 1–4, seat-bed 10 includes a main support frame 12 which is typically of unitized tubular steel of aluminum construction. Frame 12 typically includes U-shaped side frame members 14 which are spanned by tubular cross members 16. A guide rail 17 spans each frame member 14 as shown.

Seat-bed 10 also includes a seat support 18 and a back support 20. As shown, seat support 18 includes a generally rectangular tubular frame 22 and slats 24 which span across and are connected to the front and back portions of the frame 22. A slot 26 may extends between slats 24 (FIG. 1) if the latch mechanism 100 is employed, as desired later. Springs 28 may be connected to frame 22 to provide additional support. A seat cushion 30 is located atop and supported by seat support 18 in a conventional manner. Seat support 18 may also include support tubes 32 which underlie and are connected to slats 24 as shown.

Back support 20 includes a generally rectangular frame 34 spanned by slats 36. Springs 23 are connected to frame 34 to provide additional support. Back cushion 40 overlies frame 34 as shown and may be connected hereto in a conventional manner. Bracket-like connectors 42 are integrally fastened to the outermost slats 36 (one shown) to allow for fastening of a linkage to the back support.

Seat-bed 10 may be manually shifted between the aforesaid seat and bed positions by linkage system 46. Linkage 46 as shown includes a forwardmost link 48 which is pivotally connected at one end 49 to frame 12 as by a pivot bolt 50. The other end 52 of link 48 is pivotally connected to seat support tube 32 as by pivot bolt 54.

Figure 5:
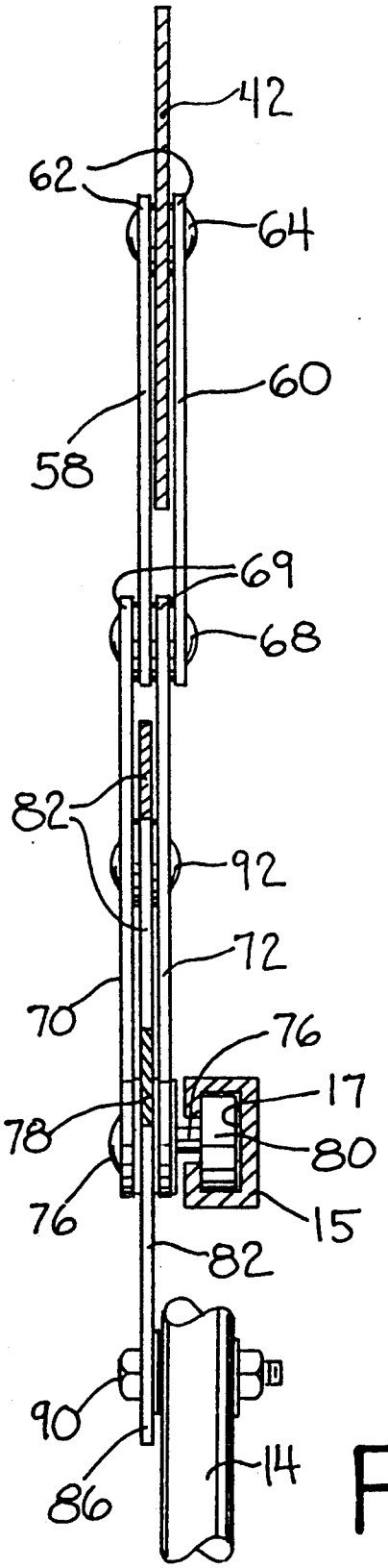
FIG. 5 is a sectional view taken along line 5—5 of FIG. 1.

Linkage system 46 also includes scissors-type linkage 56 which is pivotally connected between back support 20 and frame 12. Scissors linkage 56 as shown, includes links 58 and 60 which are substantially colinear and are connected at one end 62 to bracket 42 as by pivot pin 64. The other ends 66 of links 58, 60 are connected as by pivot pin 68 to ends 69 of colinear links 70, 72. The other ends 74 of links 70, 72 are connected as by pivot pin 76 to an end 77 of link 78. Link 82 has its ends 84, 86 connected by pins 88, 90 respectively to bracket 42 and frame member 14. A pivot pin 92 connects link 82 to colinear links 70, 72 as shown. Pivot pin 76, as shown in FIG. 5 has an enlarged cylindrical head part 80 which is slidably fitted in channel 15 of guide rail 17.

Link 78 has its other end 79 connected to an end 93 of link 94 as by pivot pin 96. The other end 95 of link 94 is slidably positioned in guide rail channel 15 by a pivot pin 98 which has an enlarged head part (not shown) similar to head part 80.

Figure 6:
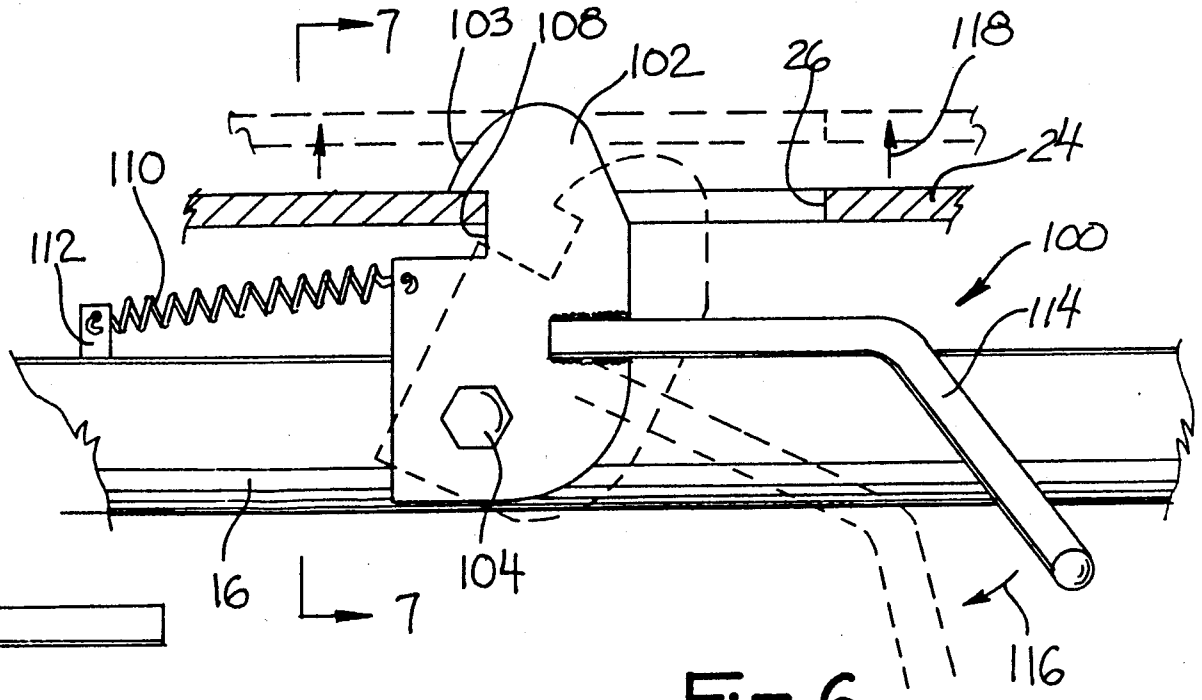
FIG. 6 is a fragmented plan view of the latch mechanism.
Figure 7:
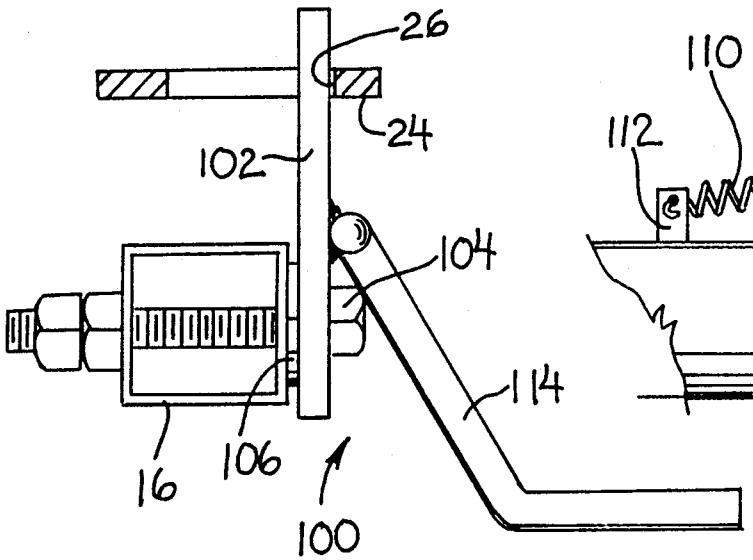
FIG. 7 is a sectional view taken along line 7—7 of FIG. 6.

FIGS. 6 and 7 show in detail the construction of latch mechanism 100. Latch mechanism 100 includes a latch plate 102 which is shiftably secured to frame members 16 as by a bolt 104 and washer 106 (see FIG. 7). Latch plate 102 defines a slotted groove 108 as shown. A spring 110 or similar biasing device is connected between plate 102 and frame member 16 as by bracket 112. Actuator handle 114 is fixedly connected to plate 102 as by welding.

Figure 1:
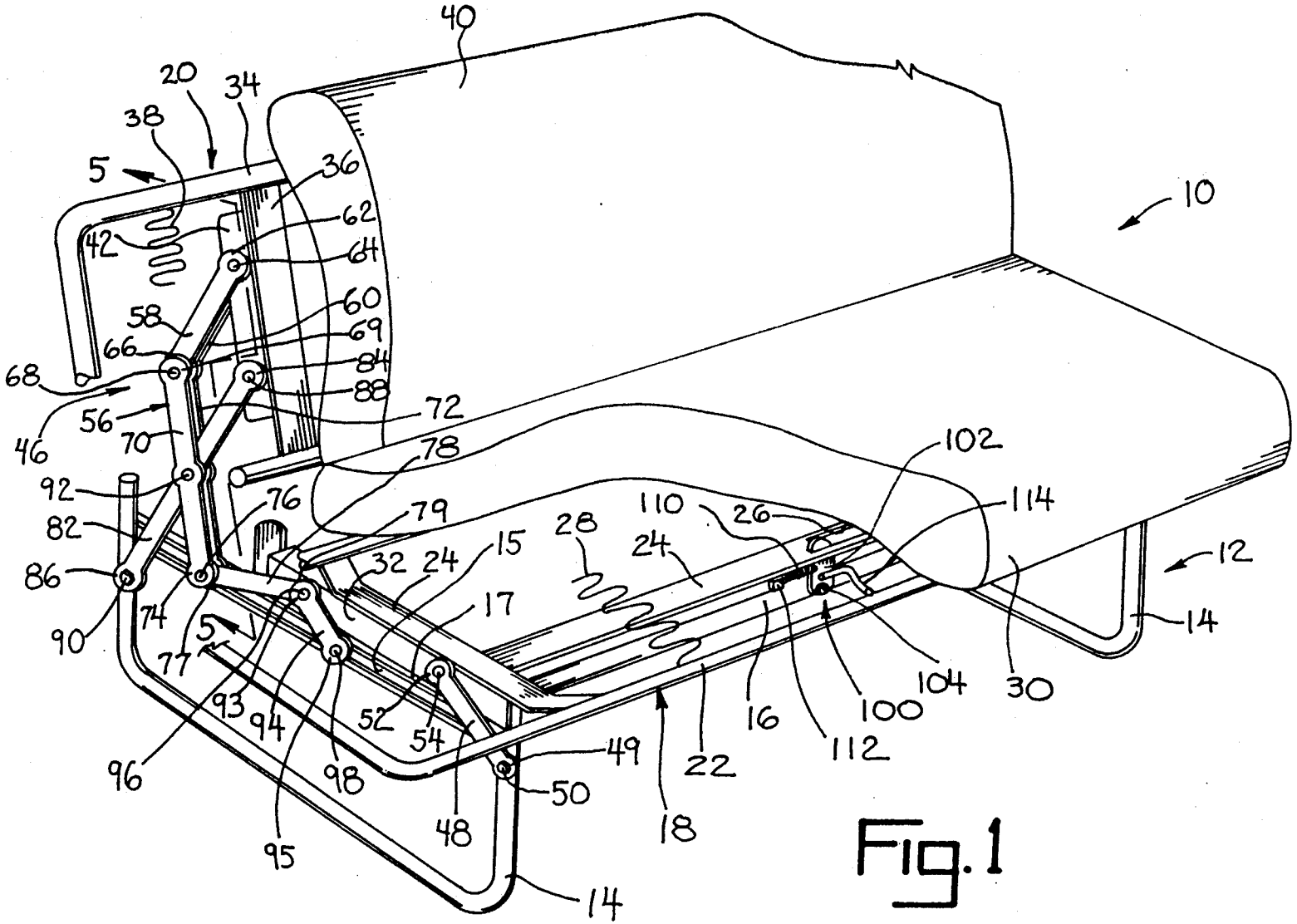
FIG. 1 is a perspective view of the convertible seat-bed of this invention in the seat position with portions cut away to illustrate the linkage system.
Figure 2:
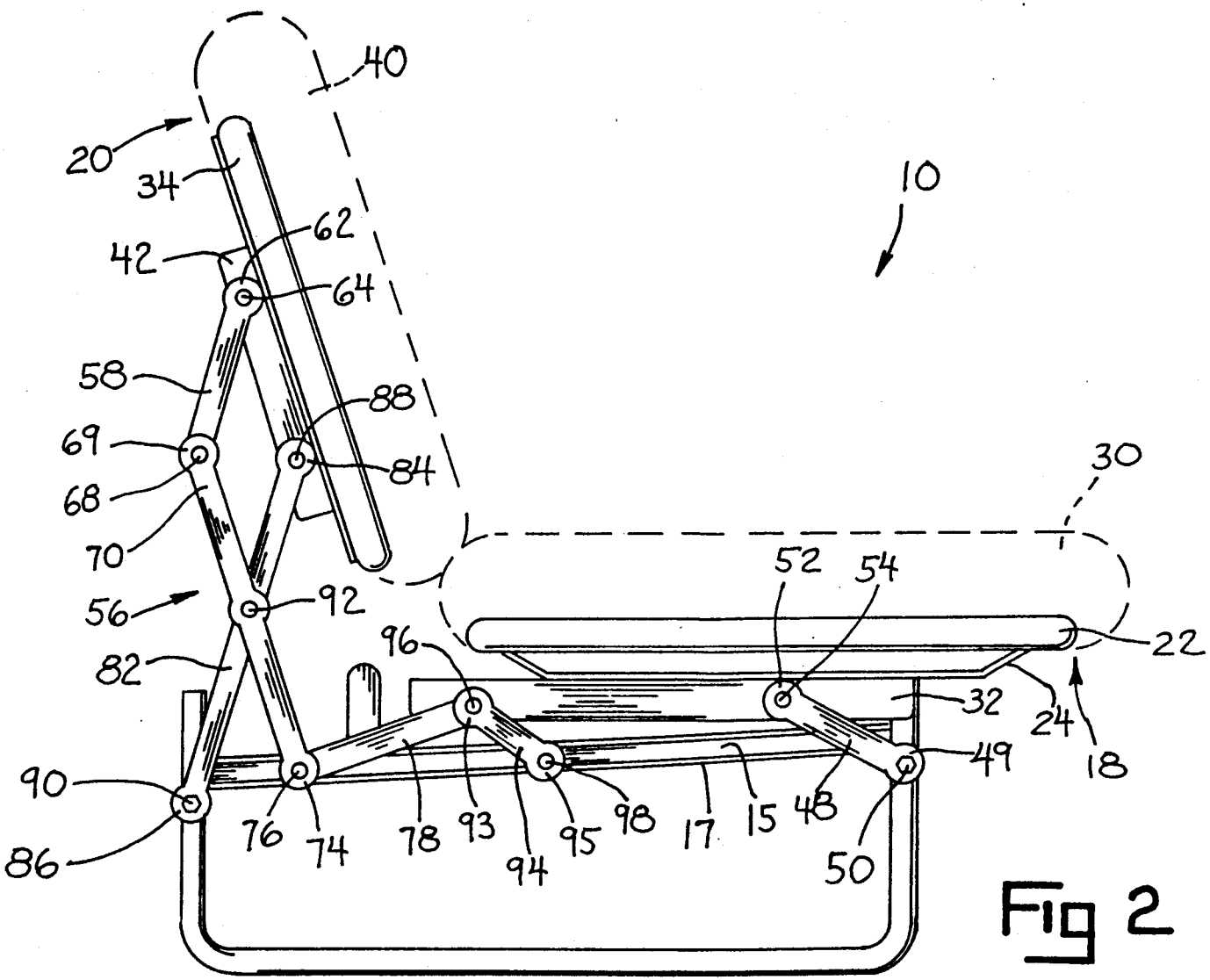
FIG. 2 is a side elevational view of the seat-bed in the seat position.
Figure 3:
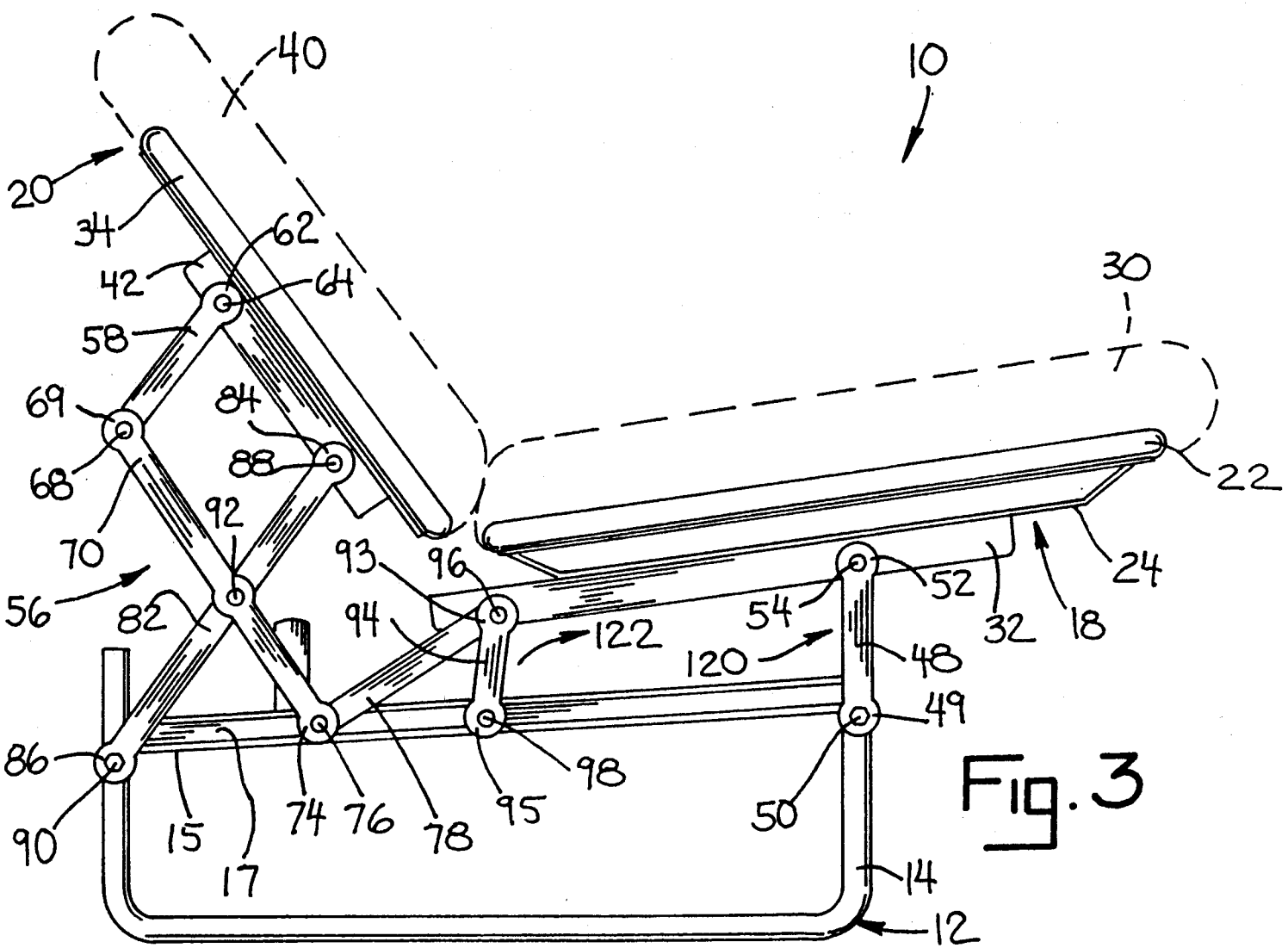
FIG. 3 is a side elevational view of the seat-bed in an intermediate position.

Seat-bed 10 is operated in the following manner. With the seat-bed 10 in the seat position of FIG. 1, latch mechanism 100 secures the seat-bed against shifting movement through engagement of latch plate groove 108 with seat support slat 24 in slot 26 (FIGS. 1 and 6). Spring 110 urges latch plate 102 towards this latched position which prevents shifting of the seat-bed 10.

To shift seat-bed 10, a user pivots handle 114 in the direction of arrow 116 (FIG. 6) to disengage latch plate 102 from slat 24. The resilient construction of slat 24 causes the slat to move upwardly in the direction of arrows 118 into the position shown by dotted lines 24' of FIG. 6. Handle 114 is then released with spring 110 urging latch plate 102 back into the latched position but no longer in engagement with slat 24. The user then pulls seat support 18 forwardly. This action causes pivoting of its connected links 48 and 94 in the direction indicated by arrows 120, 122 in FIGS. 2 and 3. The connection of link 94 through intermediate link 78 to scissors linkage 56 causes the simultaneous pivoting of the associated scissors linkage as shown in FIGS. 1–4 from the seat position (FIG. 1) to the bed position (FIG. 4). Heads 80 and the head (not shown) of pin 98 ride in guide channel 15 to ensure free and accurate pivoting of all links in the scissors linkage 56.

When seat-bed 10 is to be shifted from the bed position back into the seat position, the user pulls up on back support 20 to cause reverse pivoting of the linkage 56 and links 78, 94 and 48. When the seat-bed 10 reaches the seat position, downward force is applied to seat support 18 (as by the user sitting on the seat cushion 30) to urge slat 24 downwardly. In so doing, the slat 24 cams against curved upper edge 103 of latch 102 to again allow slot 26 to engage with latch groove 108 to secure the seat-bed 10 in a seat position.

It is understood that the above description does not limit the invention to the precise form disclosed but may be modified within the scope of the following claims.

I claim:

1. In a convertible seat-bed including a support frame, a seat support pivotally connected to said frame, a back support pivotally connected between said seat support and said frame, linkage means connecting said seat support and back support to said frame for relative movement between a seat position and a bed position, the improvement wherein said linkage means includes a first elongated link pivotally connected between said frame and said back support, a second link pivotally connected to said back support, and a third link pivotally connected between said frame and said second link wherein said first and third links form a scissors configuration, said second link includes first and second parallel link members arranged in a substantially co-linear configuration, and said third link includes first and second link members pivotally connected to said second link first and second link members.

2. The converitible seat-bed of claim 1 and means for pivotally connecting said first and third links.

3. The convertible seat-bed of claim 1 and a fourth link pivotally connected between said third link and said seat support.

4. The convertible seat-bed of claim 3 wherein said support frame includes a guide rail, means for connecting said third link to said frame guide rail at a junction of the third link and the fourth link.

5. The convertible seat-bed of claim 3 and a fifth link pivotally connected between said fourth link and said frame.

6. The convertible seat-bed of claim 5 wherein said support frame includes a guide rail, means for slidably connecting said fifth link to said guide rail.

7. The convertible seat-bed of claim 5 and a sixth link having its upper end pivotally connected to said seat support and its lower end connected to a front leg of said frame, said upper end of said sixth link swinging over said lower end as said seat-bed is moved between its said seat position and its said back position.

8. The convertible seat-bed of claim 5 and latch means connected between said frame and seat support for locking the seat-bed in said seat position.

9. The convertible seat-bed of claim 8 wherein said latch means includes a slotted latch plate pivotally connected to said frame, said seat support having a slotted opening for accepting said latch plate, biasing means connected to said frame for urging the latch plate towards a latched position contacting said seat support, and handle means for manually urging said latch plate towards an unlatched position not in contact with said seat support wherein said seat-bed may be shifted between said seat position and said bed position.

10. The convertible seat-bed of claim 9 wherein said latch plate has a rounded upper surface wherein said seat support cams the latch plate into said unlatched position.

* * * * *